US008485630B2

(12) United States Patent
Kawaguchi et al.

(10) Patent No.: US 8,485,630 B2
(45) Date of Patent: Jul. 16, 2013

(54) RECORDING-MEDIUM-CONVEYING DEVICE AND RECORDING APPARATUS

(75) Inventors: Koichiro Kawaguchi, Yokohama (JP); Yasuhiko Ikeda, Sagamihara (JP); Toshiki Takeuchi, Yokohama (JP); Kengo Nieda, Kawasaki (JP); Masahito Yoshida, Shiki (JP); Masato Izumi, Kawasaki (JP); Kenji Shigeno, Yokohama (JP); Ryosuke Sato, Kawasaki (JP); Noriyuki Sugiyama, Kawasaki (JP); Takaaki Ishida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 12/945,598

(22) Filed: Nov. 12, 2010

(65) Prior Publication Data

US 2011/0132957 A1 Jun. 9, 2011

(30) Foreign Application Priority Data

Dec. 9, 2009 (JP) ..... 2009-279915

(51) Int. Cl.
*B41J 29/38* (2006.01)

(52) U.S. Cl.
USPC ..... 347/16

(58) Field of Classification Search
None
See application file for complete search history.

(56) References Cited

U.S. PATENT DOCUMENTS

2006/0221163 A1* 10/2006 Youn ..... 347/104

FOREIGN PATENT DOCUMENTS

JP 62-215449 A 9/1987

OTHER PUBLICATIONS

U.S. Appl. No. 13/084, 387, filed Apr. 11, 2011, Masaki Maeno.
U.S. Appl. No. 12/965,774, filed Dec. 10, 2010, Ryosuke Sato.
U.S. Appl. No. 12/964,681, filed Dec. 9, 2010, Ryosuke Sato.
U.S. Appl. No. 12/941,856, filed Nov. 18, 2010, Yosui Naito.
U.S. Appl. No. 12/834,651, filed Jul. 12, 2010, Tetsuhiro Nitta.
U.S. Appl. No. 12/825,071, filed Jun. 28, 2010, Naoki Ishikawa.
U.S. Appl. No. 12/958,245, filed Dec. 1, 2010, Hironori Naka.

* cited by examiner

*Primary Examiner* — Stephen Meier
*Assistant Examiner* — Tracey McMillion
(74) *Attorney, Agent, or Firm* — Canon U.S.A., Inc. IP Division

(57) ABSTRACT

A device includes a conveying roller configured to convey a recording medium, a follower roller configured to press the recording medium against the conveying roller, a detector configured to detect a direction of skew of the conveyed recording medium, and a changer configured to change a state of contact between the recording medium and the conveying roller in accordance with a result of the detection by the detector such that a length of a portion of the conveying roller that is in contact with the recording medium in a conveyance direction is larger on a side toward which the recording medium is skewed than on an opposite side.

14 Claims, 15 Drawing Sheets

FIG. 6

UNIT: mm

| No. | AMOUNT OF OFFSET FOR PINCH ROLLER 1d | AMOUNT OF OFFSET FOR PINCH ROLLER 1c | AMOUNT OF OFFSET FOR PINCH ROLLER 1b | AMOUNT OF OFFSET FOR PINCH ROLLER 1a | AMOUNT OF SKEW AFTER CONVEYANCE BY 50 mm |
|---|---|---|---|---|---|
| 1 | 0 | 0 | 0 | 0 | 0 |
| 2 | 0 | +0.2 | +0.4 | +0.6 | -0.1 |
| 3 | 0 | +0.4 | +0.8 | +1.2 | -0.2 |
| 4 | 0 | +0.6 | +1.2 | +1.8 | -0.3 |
| 5 | 0 | +0.8 | +1.6 | +2.4 | -0.4 |
| 6 | 0 | +1 | +2 | +3 | -0.5 |
| 7 | +0.6 | +0.4 | +0.2 | 0 | +0.1 |
| 8 | +1.2 | +0.8 | +0.4 | 0 | +0.2 |
| 9 | +1.8 | +1.2 | +0.6 | 0 | +0.3 |
| 10 | +2.4 | +1.6 | +0.8 | 0 | +0.4 |
| 11 | +3 | +2.0 | +1.0 | 0 | +0.5 |

DIAMETER OF LF ROLLER: $\phi$10

DIAMETER OF PINCH ROLLER: $\phi$7

FIG. 13

UNIT: mm

| No. | LENGTH BY WHICH END 18b OF PAPER-PATH-ADJUSTING ROLLER 18 IS LOWERED | LENGTH BY WHICH END 18a OF PAPER-PATH-ADJUSTING ROLLER 18 IS LOWERED | AMOUNT OF SKEW AFTER CONVEYANCE BY 50 mm |
|---|---|---|---|
| 1 | 0 | +0 | 0 |
| 2 | 0 | +1 | -0.1 |
| 3 | 0 | +2 | -0.2 |
| 4 | 0 | +3 | -0.3 |
| 5 | 0 | +4 | -0.4 |
| 6 | 0 | +5 | -0.5 |
| 7 | +1 | 0 | +0.1 |
| 8 | +2 | 0 | +0.2 |
| 9 | +3 | 0 | +0.3 |
| 10 | +4 | 0 | +0.4 |
| 11 | +5 | 0 | +0.5 |

DIRECTION IN WHICH END OF PAPER-PATH-ADJUSTING ROLLER IS LOWERED IS REPRESENTED BY +

RECORDING-MEDIUM-CONVEYING DEVICE AND RECORDING APPARATUS

BACKGROUND OF THE INVENTION

1. Field of the Invention

The present invention relates to a recording-medium-conveying device that conveys a recording medium and performs skew correction, and to a recording apparatus including the recording-medium-conveying device.

2. Description of the Related Art

In recording apparatuses in which images are formed by recording units while recording media are conveyed, various measures have been taken for improving the accuracy in conveyance of the recording media. If a recording medium is gradually deviates from a reference position while being conveyed, an image may not be formed correctly on the recording medium, resulting in image failure due to deviation in print position. To solve such a problem, some measures have been taken in the related art. An exemplary measure will be described below.

In Japanese Patent Laid-Open No. 62-215449, a recording medium is nipped between and is conveyed by a first roller made of an elastic material and a second roller made of a rigid material and facing the first roller. The contact pressure produced at the nip between the first and second rollers is adjustable in such a manner as to vary with the position in the recording-medium-width direction. According to such a configuration, when the contact pressure on one side in the recording-medium-width direction is increased, the first roller, which is an elastic member, is deformed, whereby the radius of the roller that conveys the recording medium is reduced. Therefore, the length of conveyance on the side where the contact pressure has been increased is reduced. Thus, any skew of the recording medium is corrected.

In recent years, however, it has become popular that printing is performed on glossy photo paper so that an image having as high quality as photographic quality can be obtained. Particularly, inkjet recording apparatuses have been desired to be capable of recording dots of microscopic sizes at higher density and with higher definition. Under such circumstances, the accuracy in conveyance of a recording medium needs to be improved dramatically, and the recording medium needs to be treated more carefully when printing is performed than in related-art cases. In this respect, mechanisms and control methods in the related art have faced limits.

Specifically, techniques in the related art have problems described below.

Since the print surface of glossy photo paper is highly specular and vulnerable, if the contact pressure produced at the nip between a pair of conveying rollers is increased, the print surface may have scratches and/or marks due to the increased contact pressure, deteriorating the print quality.

Moreover, since the roller for conveying the recording medium is deformed, the diameter of the roller may change during conveyance, resulting in unstable conveyance accuracy. Even a slight change in the diameter of the roller may lead to a non-negligible error in terms of accuracy in the conveyance of recording media on which high-definition images are to be formed as demanded in recent years.

In some cases, to drive the conveying roller with higher accuracy, a rigid roller made of a metal shaft coated with ceramic is employed. Such a rigid roller, however, is not applicable to the technique of correcting a skew by deforming a roller.

SUMMARY OF THE INVENTION

According to an aspect of the present invention, a device includes a conveying roller configured to convey a recording medium, a follower roller configured to press the recording medium against the conveying roller, a detector configured to detect a direction of skew of the conveyed recording medium, and a changer configured to change a state of contact between the recording medium and the conveying roller in accordance with a result of the detection by the skew detector such that a length of a portion of the conveying roller that is in contact with the recording medium in a conveyance direction is larger on a side toward which the recording medium is skewed than on an opposite side.

Further features of the present invention will become apparent from the following description of exemplary embodiments with reference to the attached drawings.

BRIEF DESCRIPTION OF THE DRAWINGS

FIG. 6 is a table summarizing the lengths of movement of pinch rollers and the amounts of skew corresponding thereto.

FIG. 13 is a table summarizing the lengths of movement of ends of a paper-path-adjusting roller and the amounts of skew corresponding thereto obtained from an experiment.

DESCRIPTION OF THE EMBODIMENTS

Recording apparatuses including recording-medium-conveying devices according to embodiments of the present invention will now be described with reference to the accompanying drawings.

While the following embodiments concern exemplary recording apparatuses of inkjet type employing serial heads, the embodiments are also applicable to recording apparatuses employing line heads. Herein, recording media in the form of sheets or rolls, such as paper, plastic sheets, and films, are generally referred to as "recording paper".

Figure 1A:
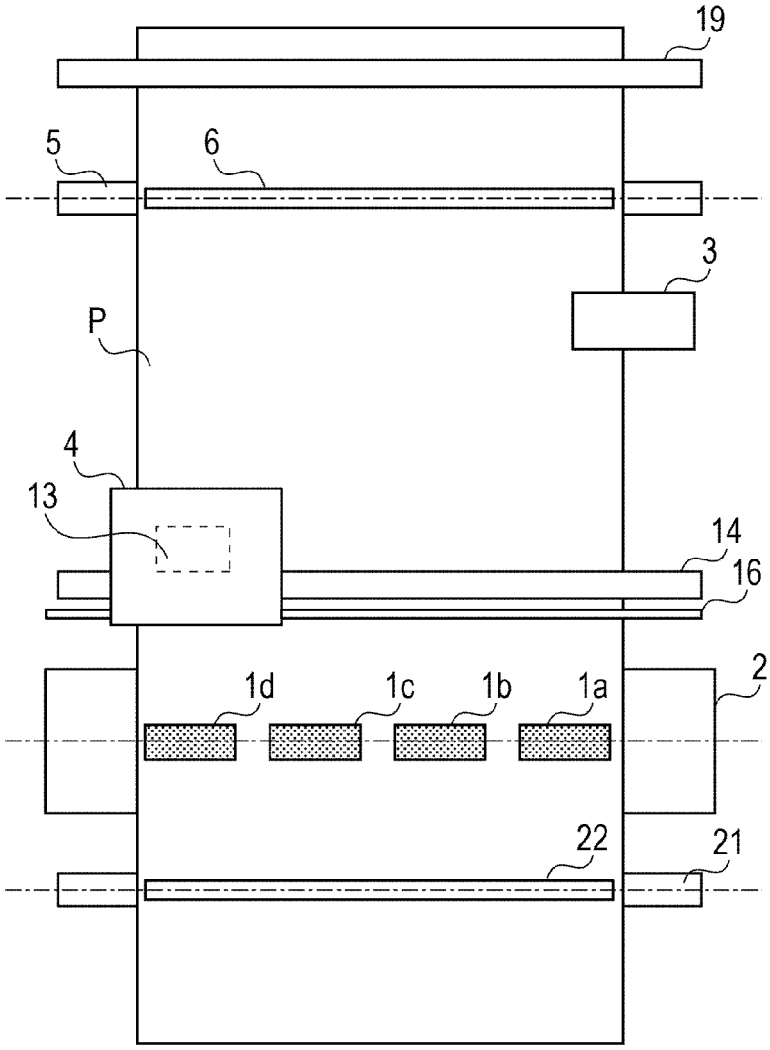
FIGS. 1A and 1B show an inkjet recording apparatus according to a first embodiment of the present invention.
Figure 1B:
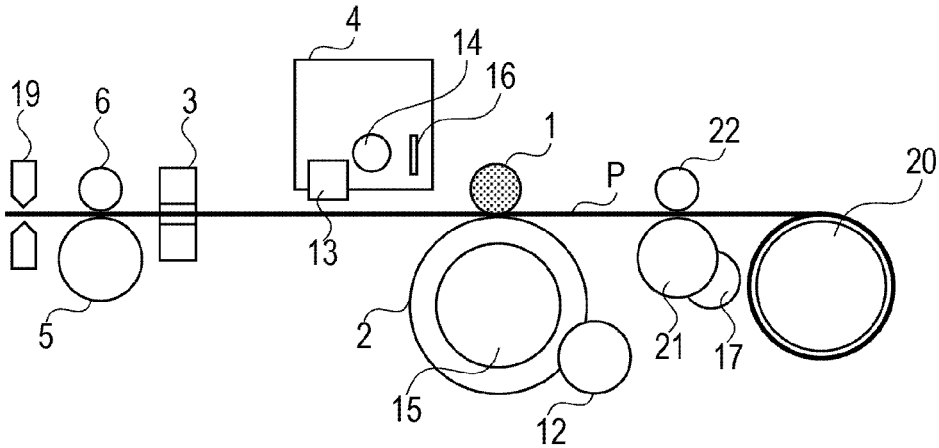

FIG. 1A is a top view of a recording-paper-conveying unit included in a recording apparatus according to a first embodiment of the present invention. FIG. 1B is a cross-sectional view of the conveying unit.

Referring to FIGS. 1A and 1B, recording paper P is a roll of continuous-form paper that is continuously fed by being unwound from the roll. A roll paper holder 20 holds the roll of recording paper P. A feed roller 21 feeds the recording paper P unwound from the roll held by the roll paper holder 20. A feed pinch roller 22 is opposed to the feed roller 21 in such a manner as to press the recording paper P. A feed motor 17 drives the feed roller 21. A linefeed (LF) roller 2 is a conveying roller that accurately conveys the recording paper P. The LF roller 2 and a follower roller 1 in combination nip and convey the recording paper P. The follower roller 1 includes four pinch rollers 1*a*, 1*b*, 1*c*, and 1*d* provided in that order from the right in FIG. 1A. Normally, the axis of the follower roller 1 is substantially parallel to the axis of the LF roller 2. The LF roller 2 rotates in response to the driving of a linefeed (LF) motor 12. A linefeed (LF) rotary encoder 15 detects the speed, angle, and phase of rotation of the LF roller 2. The conveyance of the recording paper P is controlled in accordance with a detection signal from the LF rotary encoder 15. A skew sensor 3, which is a skew detector, detects the direction and amount of skew of the recording paper P. The skew sensor 3 includes a transmission laser sensor with which the position of a side end of the recording paper P is detected. A recording head 13 performs recording by ejecting ink toward the recording paper P. A carriage 4 carries the recording head 13 and scanningly moves back and forth along a carriage shaft 14 and above the recording paper P. A carriage linear encoder 16 detects the position of the carriage 4. Ink is ejected from the recording head 13 in accordance with the detected position of the carriage 4, whereby an image is accurately formed on the recording paper P.

A discharge roller 5 discharges the recording paper P that has undergone recording. The discharge roller 5 and a discharge pinch roller 6 in combination nip and convey the recording paper P. A cutter 19 cuts the recording paper P that has undergone recording, whereby a portion of the recording paper P, which is continuous-form paper, having an image recorded thereon is separated.

Figure 2A:
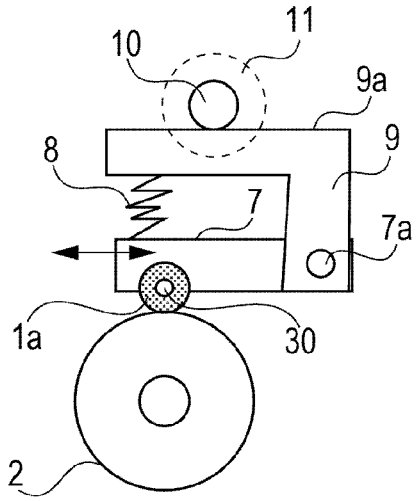
FIGS. 2A and 2B show the inkjet recording apparatus.

FIG. 2A is a side view showing details of relevant parts near the LF roller 2 and the follower roller 1. The pinch rollers 1*a* to 1*d* are fixed on a pinch roller shaft 30. Referring to FIG. 2A, one end of the pinch roller shaft 30 is rotatably supported by a bearing provided on a pinch roller holder 7. A pinch-roller-holder frame 9 holds the pinch roller holder 7 such that the pinch roller holder 7 is rotatable about a holder shaft 7*a*. A pinch roller spring 8 causes, through the intermediary of the pinch roller holder 7, the pinch rollers 1*a* to 1*d* to be pressed against the LF roller 2. The pinch-roller-holder frame 9 is supported by a guide member (not shown) in such a manner as to be slidable in a conveyance direction. A rack portion 9*a* is provided at the top of the pinch-roller-holder frame 9. A pinion gear 10 meshes with the rack portion 9*a*, thereby moving the pinch-roller-holder frame 9. A pinch roller motor 11 drives the pinion gear 10.

The other end of the pinch roller shaft 30 may be supported by another bearing whose position is fixed, or may be supported by another pinch roller holder 7 that is movable by a motor. If the other end of the pinch roller shaft 30 is configured to be movable, another set of a pinch-roller-holder frame 9, a rack portion 9*a*, and a pinch roller motor 11 that form a pinch-roller-moving mechanism is also provided at the other end of the pinch roller shaft 30.

The recording head 13 in the first embodiment is of inkjet type in which ink is ejected by utilizing thermal energy. The recording head 13 includes a plurality of electrothermal conversion members that generate thermal energy. Specifically, the electrothermal conversion members generate thermal energy in accordance with a pulse signal applied thereto, whereby film boiling occurs in the ink. With a foaming pressure produced by the film boiling, the ink is ejected from ejection ports, and recording is thus performed.

Figure 3:
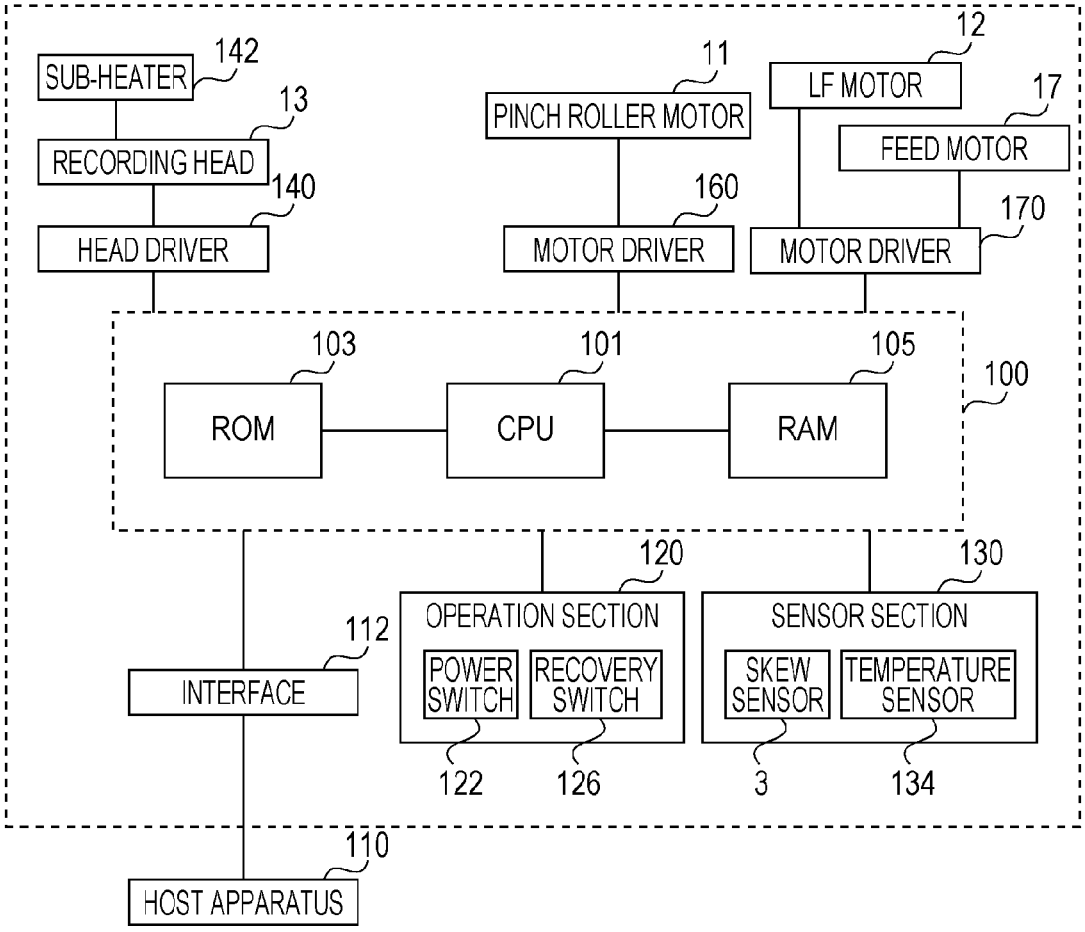
FIG. 3 shows a control system of the inkjet recording apparatus.

FIG. 3 is a block diagram for describing a control system of the inkjet recording apparatus according to the first embodiment.

Referring to FIG. 3, a controller 100 is a main controller of the recording apparatus. The controller 100 includes, for example, microcomputers such as a central processing unit (CPU) 101, a read-only memory (ROM) 103 storing fixed data including programs, tables, and the like, and a random access memory (RAM) 105 having a space for decompressing image data, workspaces, and the like.

A host apparatus 110 is an image source externally connected to the recording apparatus. The host apparatus 110 may be a computer that generates and/or processes data, such as an image, relevant to recording, or a reader intended for image reading. Image data, commands, status signals, and the like supplied from the host apparatus 110 are transmittable to the controller 100 through an interface 112 that allows communication between the host apparatus 110 and the controller 100.

An operation section 120 is a group of switches that accept input instructions made by an operator and includes a power switch 122, a recovery switch 126 that instructs to start recovery by suction, and so forth.

A sensor section 130 is a group of sensors that detect various statuses of the apparatus. In the first embodiment, the sensor section 130 includes the skew sensor 3, a temperature sensor 134 that detects the ambient temperature, and various other sensors.

A head driver 140 drives the recording head 13 in accordance with recording data. The head driver 140 includes a timing setter that appropriately sets the timing of ejection so that the positions of dots to be formed on the recording paper P are adjusted, and so forth.

A sub-heater 142 is provided near the recording head 13. The sub-heater 142 adjusts the temperature of the recording head 13 so that the characteristic of ink ejection is stabilized. The sub-heater 142 may be provided on a substrate of the recording head 13, or on the body of the recording head 13.

A motor driver 170 drives the LF motor 12 and the feed motor 17. When the feed motor 17 is driven, the recording paper P is fed from the roll. When the LF motor 12 is driven, the recording paper P is conveyed toward a print unit. A motor driver 160 drives the pinch roller motor 11. When the pinch roller motor 11 is driven, the position of an end of the pinch roller shaft 30 is changed. In the case where only one end of the pinch roller shaft 30 is movable, one pinch roller motor 11 is provided. In the case where both ends of the pinch roller shaft 30 are movable, two pinch roller motors 11 are provided and are controlled independently of each other. Alternatively, the four pinch rollers 1*a* to 1*d* may be supported by four pinch roller holders 7, respectively, and be provided with four pinch-roller-moving mechanisms, respectively, each including a pinch-roller-holder frame 9, a rack portion 9*a*, and a pinch roller motor 11. In that case, the four pinch roller motors 11 are to be controlled independently of one another.

Figure 2B:
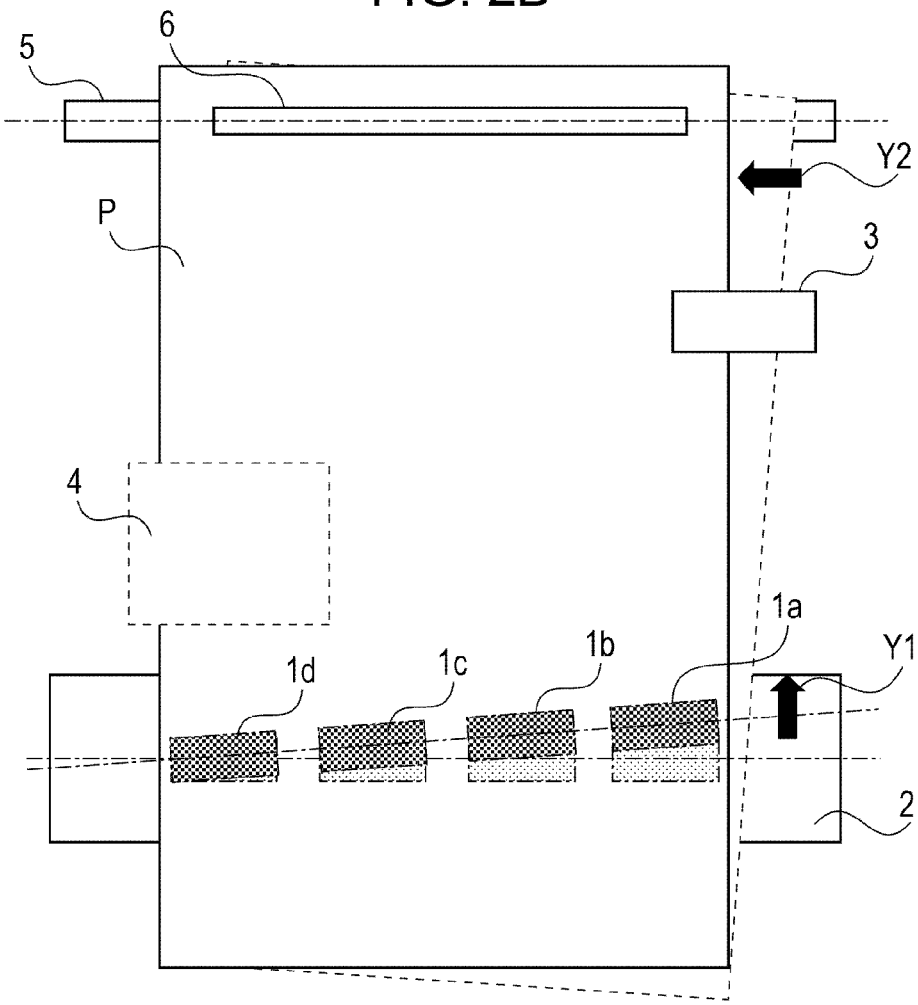
Figure 4:
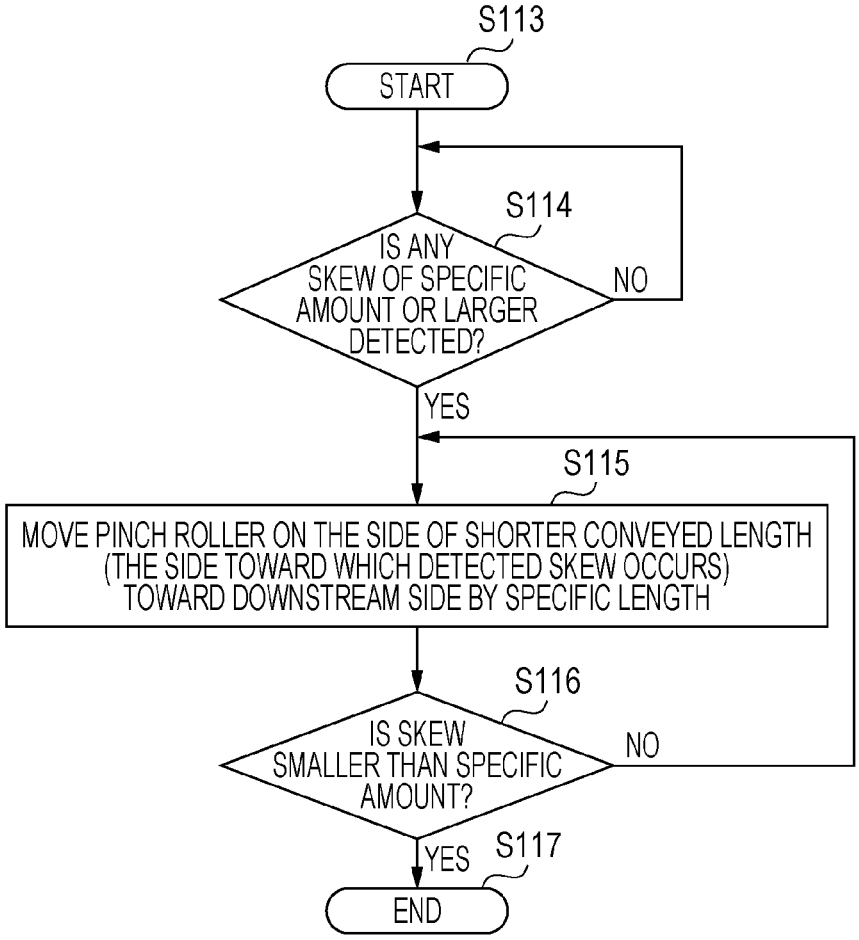
FIG. 4 is a flowchart of a skew-correcting operation.

A correcting operation performed in the recording apparatus having the above configuration when any skew of the recording paper P occurs will now be described. FIG. 2B is a top view for describing a skew-correcting operation. FIG. 4 is a flowchart of the skew-correcting operation. If the skew sensor 3 detects any skew of a specific amount or larger during conveyance of the recording paper P, the skew-correcting operation is performed (step S114). For example, if a skew of 0.3 mm or larger occurs during conveyance by 50 mm, the skew-correcting operation is performed. In FIG. 2B, the recording paper P is skewed as represented by the broken line. To correct such a skew, the axis of the follower roller 1 is moved in direction Y1 shown in FIG. 2B (step S115). Specifically, the pinch roller motor 11 provided at the end near the pinch roller 1*a* is driven, whereby the pinch-roller-holder frame 9 is moved toward the downstream side in the conveyance direction. Since a rightward skew occurs in the case shown in FIG. 2B, the pinch roller 1*a* at the rightmost position is moved most significantly toward the downstream side. The lengths of movement of the pinch rollers 1*a* to 1*d* decrease toward the pinch roller 1*d*. That is, the length of movement of the pinch roller 1*d* at the leftmost position, i.e., on the side opposite the skewed-direction side, is the smallest. The pinch rollers 1*a* and 1*b* positioned on the skewed-direction side with respect to the center are moved more significantly than the pinch rollers 1*c* and 1*d* positioned on the opposite side with respect to the center. Thus, the recording paper P is moved in direction Y2 shown in FIG. 2B, whereby the skew is corrected. In the first embodiment, the follower roller 1 is moved such that the axis thereof is tilted by the pinch-roller-moving mechanisms provided at both ends of the pinch roller shaft 30. In the case where a pinch-roller-moving mechanism is provided for each of the pinch rollers 1*a* to 1*d*, the individual pinch rollers 1*a* to 1*d* are moved translationally in the conveyance direction while the lengths of movement thereof are varied in such a manner as to become larger toward the pinch roller 1*a*. Even in such a case, the same effect as described above is produced. The threshold for the amount of skew is set on the basis of relevant characteristics of the recording apparatus so as to fall within such a range that the resulting deviation in print position is permissible as the expected image. Accordingly, the quality of printed image is maintained to be constantly high. As described with reference to FIG. 2A, when the pinch roller motors 11 provided on the right and left ends of the follower roller 1 are driven, the pinch-roller-holder frame 9 is moved, whereby the positions of the right and left ends of the follower roller 1 are varied in the direction indicated by the arrow shown in FIG. 2A.

The length of movement of the follower roller 1 is varied in accordance with the amount of skew detected by the skew sensor 3. In the first embodiment, the length of movement of the follower roller 1 is determined on the basis of a table, shown in FIG. 6, stored in advance in the ROM 103.

FIG. 6 summarizes the lengths by which the pinch rollers 1*a* to 1*d* are moved in the conveyance direction and the amounts of skew K (see FIG. 5C) occurring when the recording paper P is conveyed by 50 mm with the pinch rollers 1*a* to 1*d* having been moved by those lengths. The amounts of skew K summarized in FIG. 6 were obtained in advance from an experiment.

Figure 5A:
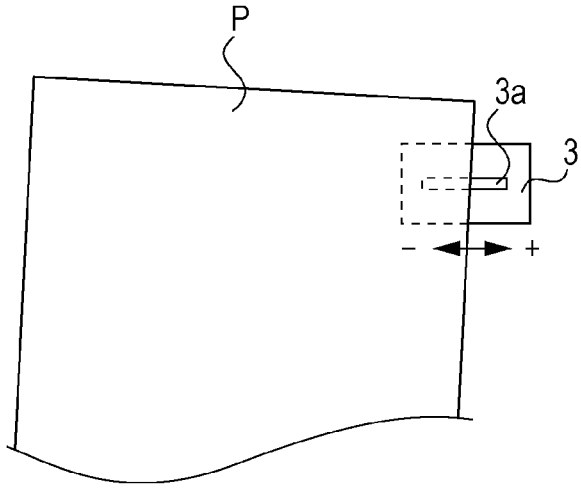
FIGS. 5A, 5B, and 5C show the configuration of a skew sensor according to the first embodiment and exemplary outputs thereof.
Figure 5B:
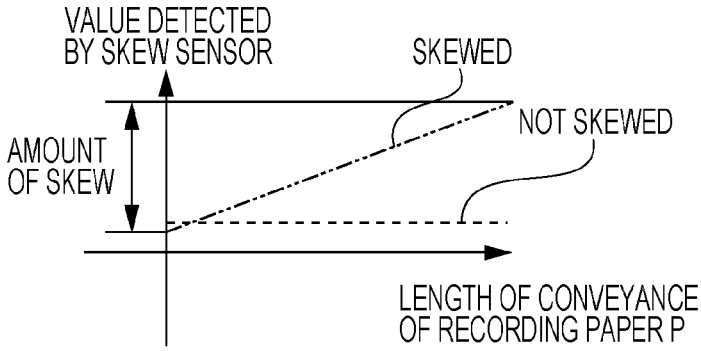
Figure 5C:
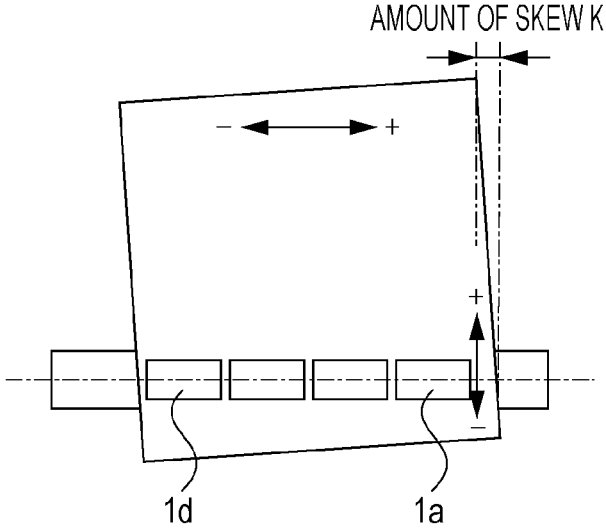

For example, when a skew of 0.3 mm occurs in the positive (+) direction, i.e., in the rightward direction in FIG. 5C, referring now to No. 4 in FIG. 6, the pinch rollers 1*a*, 1*b*, and 1*c* are moved by +1.8 mm, +1.2 mm, and +0.6 mm in the conveyance direction. In this state, the recording paper P is conveyed by 50 mm. Then, because of the moving of the pinch rollers 1*a* to 1*c*, another skew of −0.3 mm occurs. Consequently, the skew of +0.3 mm is cancelled out by the skew of −0.3 mm and is thus corrected.

The above experimental result was obtained with an LF roller 2 having a diameter of 10 mm and pinch rollers 1*a* to 1*d* having a diameter of 7 mm. If the rollers 2 and 1*a* to 1*d* have diameters different from the foregoing, experimental values are to be newly obtained.

The amounts of offset are determined with reference to the experimental values, such as those summarized in FIG. 6, obtained in advance. Actually, however, the repeatability varies. Therefore, the value detected by the skew sensor 3 is fed back and the amounts of offset are adjusted, whereby more accurate correction is realized (step S116). When the skew becomes smaller than the specific amount, the skew-correcting operation ends (step S117).

FIGS. 5A and 5B show the configuration of the skew sensor 3 and exemplary results of detection. FIG. 5A shows the relationship between the skew sensor 3 and the recording paper P. The skew, if any, is detected by detecting the position of one side end of the recording paper P placed over a laser detector 3*a* of the skew sensor 3. In FIG. 5A, the rightward direction is defined as the positive (+) direction, and the leftward direction is defined as the negative (−) direction. FIG. 5B shows exemplary results of skew detection by the skew sensor 3. The result represented by the broken line shows that there is no change in the value detected by the skew sensor 3 while the recording paper P is conveyed. Therefore, it is determined that the recording paper P is not skewed. The result represented by the two-dot chain line shows that the value detected by the skew sensor 3 changes as the recording paper P is conveyed. If the amount of change (skew) detected during the conveyance of a specific length exceeds a specific amount (for example, 0.3 mm), skew correction is performed.

Figure 7A:
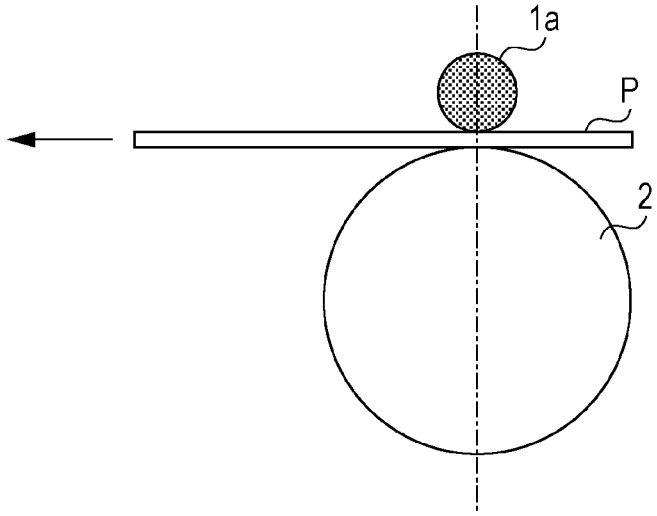
FIGS. 7A and 7B are diagrams for describing the principle of skew correction according to the first embodiment.
Figure 7B:
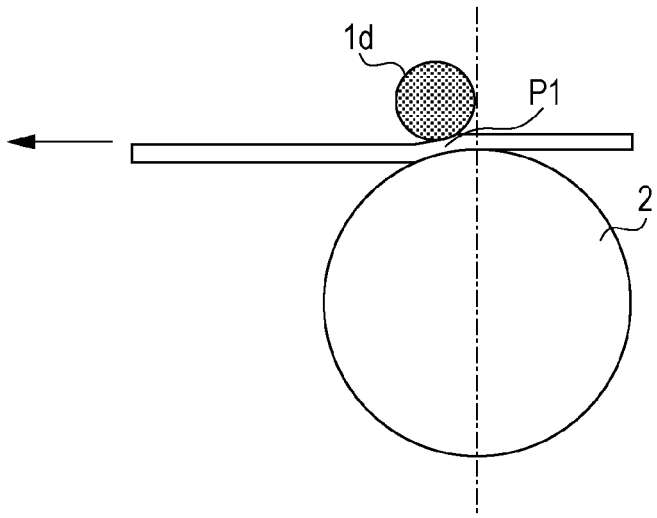

The principle of skew correction realized by varying the amount of offset of the follower roller 1 will now be described. FIGS. 7A and 7B are cross-sectional views of the pinch roller 1*a* that is offset by 0 mm and the pinch roller 1*d* that is offset by +3 mm, respectively. The direction indicated by the arrow in each of FIGS. 7A and 7B corresponds to the conveyance direction. In FIG. 7A, only a linear portion of the recording paper P is in contact with the LF roller 2 at the nip. Accordingly, the portion of the recording paper P that is in contact with the LF roller 2 is short in the conveyance direction. In FIG. 7B, the pinch roller 1*d* is offset in the conveyance direction, and a portion (P1) of the recording paper P runs along the LF roller 2. Accordingly, the portion of the recording paper P that is in contact with the LF roller 2 is longer in the conveyance direction than that on the side shown in FIG. 7A. With such an effect, a conveyance force received by a portion of the recording paper P on the side near the pinch roller 1*d* increases relative to the conveyance resistance, and the length of conveyance per unit rotation of the LF roller 2 on the side near the pinch roller 1*d* is relatively longer than that on the side near the pinch roller 1*a* that is not offset. Thus, the length of conveyance of the recording paper P is varied between that on the side near the pinch roller 1*a* and that on the side near the pinch roller 1*d*. Consequently, the skew is corrected. To gradually change the difference in the length of conveyance, the difference in the amount of offset between the pinch rollers 1*a* and 1*d* is proportionally allocated between the pinch rollers 1*b* and 1*c* on the basis of the positions of the pinch rollers 1*b* and 1*c* in the paper width direction. The experimental values summarized in FIG. 6 show such changes in the length of conveyance occurring because of the above-described effect.

Thus, the pinch-roller-moving mechanisms each function as a contact-state changer that changes the state of contact between the recording paper P and the LF roller 2.

Since skew correction is performed by changing only the amounts of offset for the pinch rollers 1*a* to 1*d*, the first embodiment of the present invention is applicable to rollers made of various materials, without limitations such as the use of an elastic roller as required in the related art.

Figure 8:
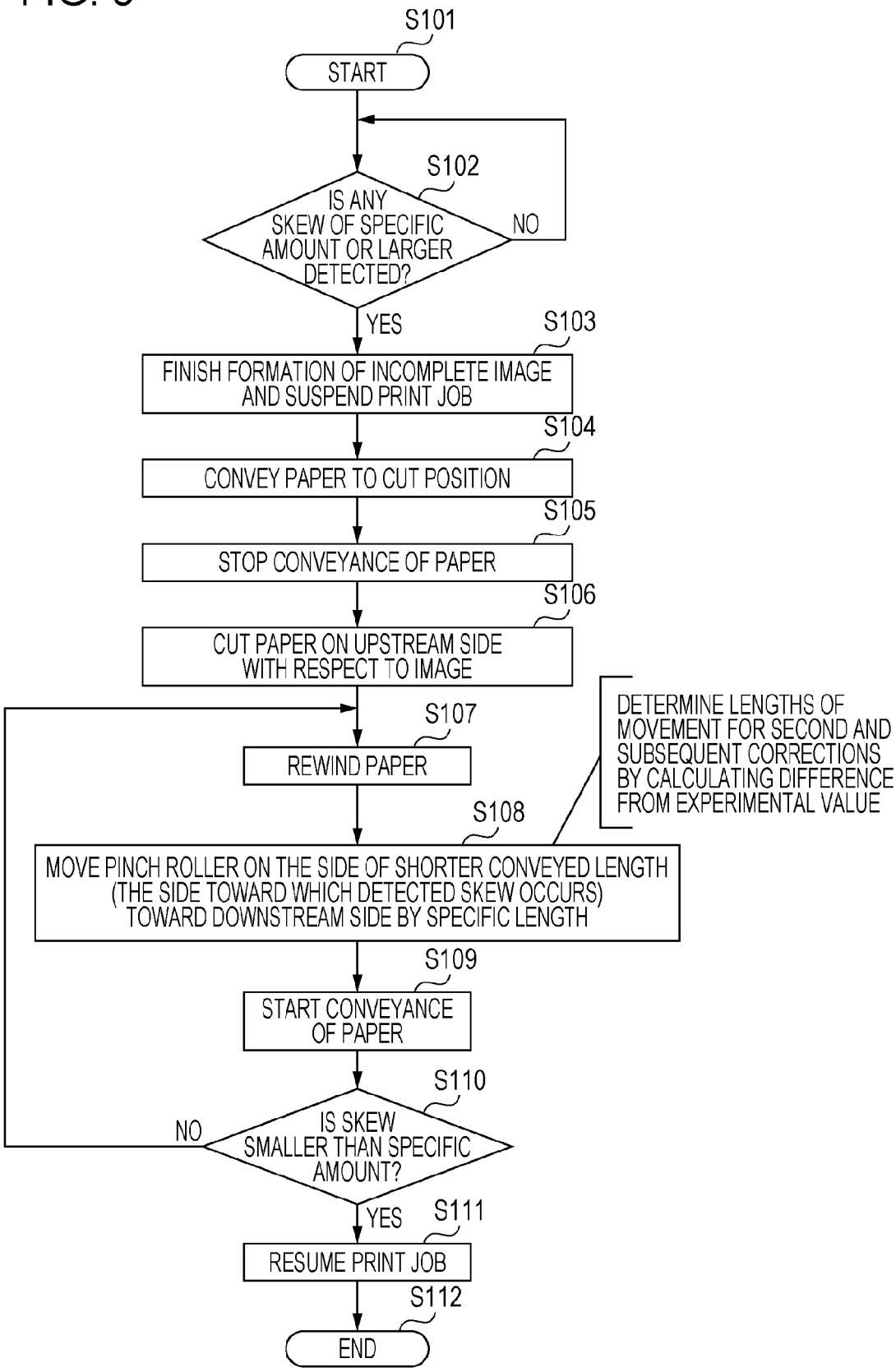
FIG. 8 is a flowchart of another skew-correcting operation according to the first embodiment.

Another exemplary control operation will now be described. As described in the flowchart shown in FIG. 8, printing may be suspended when skew correction is performed.

In such a control operation, if any skew is detected, the current print job is finished first (step S103). Subsequently, the recording paper P, which is continuous-form paper, is cut by the cutter 19 provided on the downstream side with respect to the discharge roller 5 (step S106), and the remaining portion of the recording paper P is rewound to a position on the upstream side with respect to the follower roller 1 by the LF roller 2 and the feed roller 21 (step S107). In this state where the recording paper P is not nipped between the LF roller 2 and the follower roller 1, the operation proceeds to the next step. In the example shown in FIG. 2B, the recording paper P is skewed in the rightward direction as represented by the broken line. To correct such a skew, the axis of the follower roller 1 is moved in direction Y1 shown in FIG. 2B (step S108). Specifically, the pinch roller 1*a* at the rightmost position, i.e., on the skewed-direction side, is most significantly moved toward the downstream side, and the lengths of movement of the pinch rollers 1*a* to 1*d* decrease toward the pinch roller 1*d*. That is, the length of movement of the pinch roller 1*d* is the smallest. The lengths of movement of the pinch rollers 1*a* to 1*d* are first set to the values corresponding to any of the skews obtained from the experiment summarized in FIG. 6. After the pinch rollers 1*a* to 1*d* are moved, the recording paper P is conveyed by a specific length and the amount of skew is measured with the skew sensor 3 before printing is resumed, so as to check if the skew is corrected as expected (step S110). If the skew has been corrected as expected, printing is resumed at that position (step S111).

If the skew is not smaller than the specific amount even after the above correcting operation, the pinch rollers 1*a* to 1*d* are moved again in accordance with the difference from the specific amount. The lengths of movement are determined taking into consideration the difference between the experimental value and the actually corrected amount of skew.

For example, a case will be considered where a skew of +0.2 mm has occurred after conveyance by 50 mm. To correct this skew, referring to FIG. 6, the pinch rollers 1*a*, 1*b*, and 1*c* are moved toward the downstream side by +1.2 mm, +0.8 mm, and +0.4 mm, respectively (see No. 3 in FIG. 6). In this state, the recording paper P is conveyed and the amount of skew is measured. If the measured skew is +0.1 mm after conveyance by 50 mm, the recording paper P is rewound to a position on the upstream side with respect to the pinch rollers 1*a* to 1*d*, and the pinch rollers 1*a* to 1*d* are moved again. According to the above measurement, moving the pinch roller 1*a* by +1.2 mm has corrected the skew by −0.1 mm. Hence, to correct a skew of +0.1 mm that has not been corrected, the pinch rollers 1*a*, 1*b*, and 1*c* are further moved toward the downstream side by +1.2 mm, +0.8 mm, and +0.4 mm, respectively.

By producing the state in which the recording paper P is not nipped between the follower roller 1 and the LF roller 2 while the follower roller 1 is offset, skew correction for, for example, very thin recording paper P that is easily wrinkled by the movement of the follower roller 1 is performed without damaging the recording paper P. Skew correction may be performed in different manners for different kinds of paper. That is, skew correction for normal recording paper is performed in accordance with the flowchart shown in FIG. 4, and skew correction for very thin recording paper is performed in accordance with the flowchart shown in FIG. 8.

Figure 9:
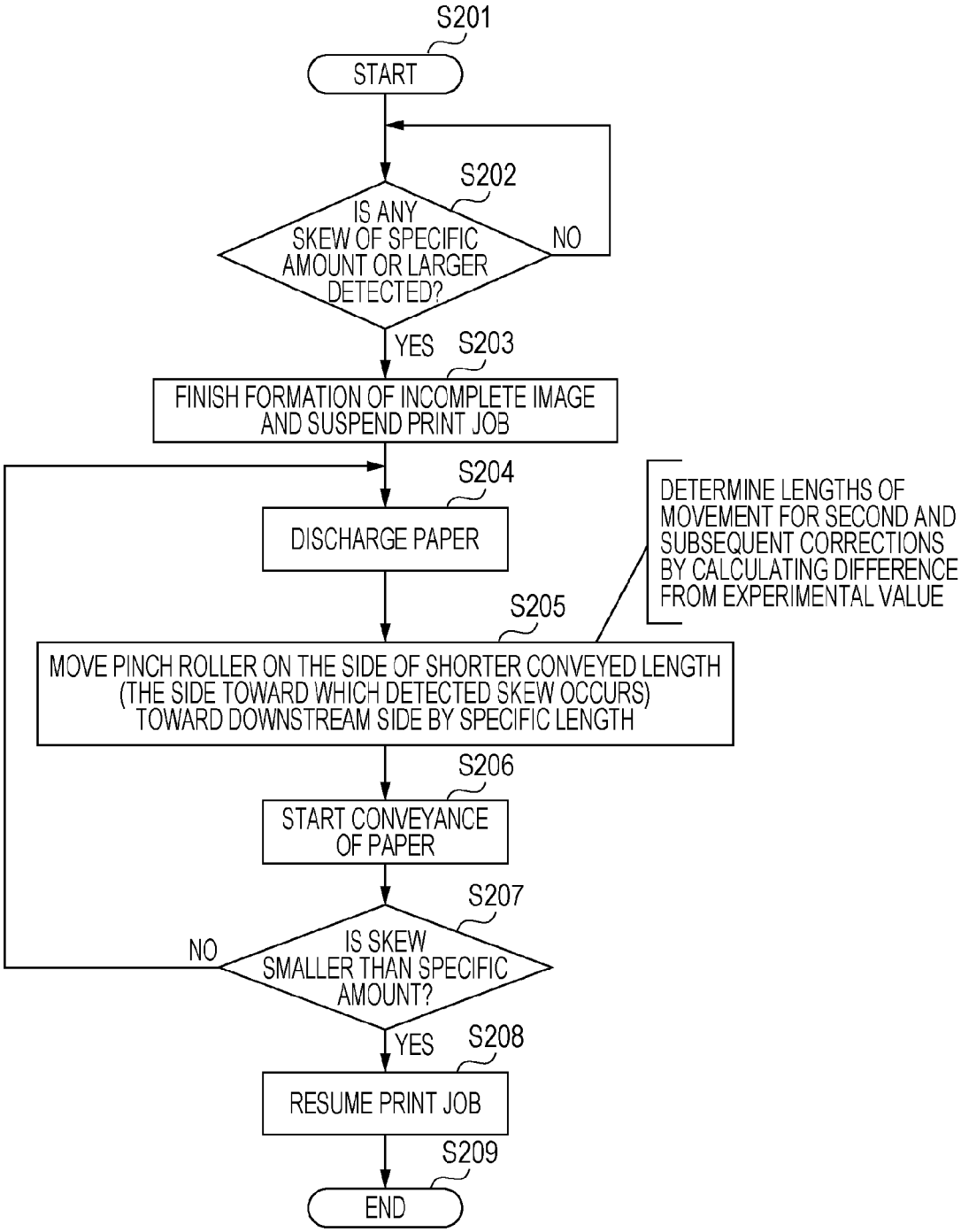
FIG. 9 is a flowchart of a skew-correcting operation for cut paper according to the first embodiment.

In addition, skew correction for cut paper is performed in accordance with the flowchart shown in FIG. 9, in which the paper is discharged (step S204) when skew correction is performed. The other steps of the correcting operation are the same as those described above.

In the first embodiment, the pinch rollers 1*a* to 1*d* are arranged in one line along the LF roller 2. The present invention is also applicable to a configuration in which rows of pinch rollers are arranged side by side in the conveyance direction. In that case, the pinch rollers may be moved simultaneously in a specific direction.

The recording head 13 described above is a serial head that performs printing by moving back and forth. Alternatively, the recording head 13 may be a line head including a plurality of recording heads provided side by side in the conveyance direction.

According to the first embodiment of the present invention, skew correction is performed assuredly without deforming the conveying roller and deteriorating the conveyance accuracy or without damaging the recording medium with scratches and/or marks, regardless of the material of the conveying roller. Consequently, highly accurate conveyance of the recording medium is realized. Thus, the occurrence of deviation in image position due to a skew of the recording medium is prevented, and a high-quality printed image is output.

Figure 10A:
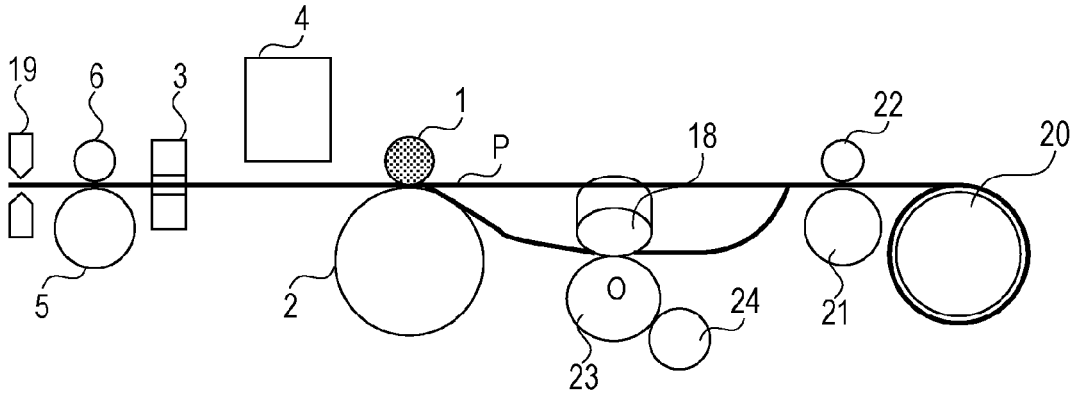
FIGS. 10A and 10B show a recording apparatus according to a second embodiment of the present invention.
Figure 10B:
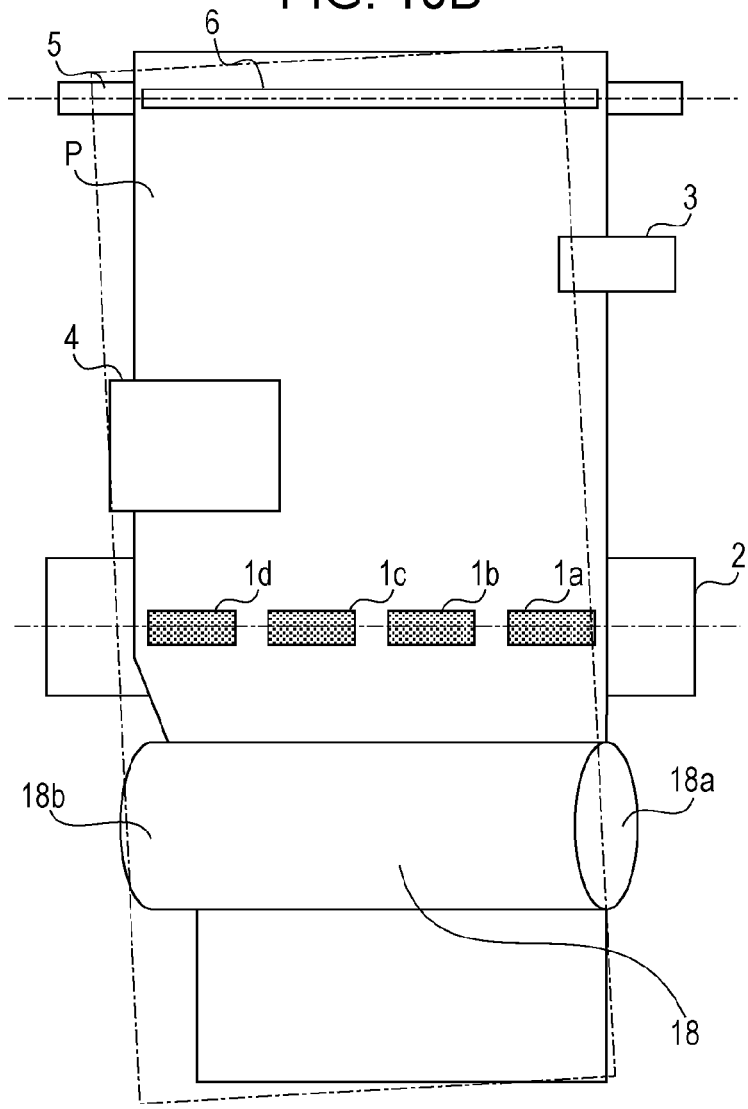
Figure 11:
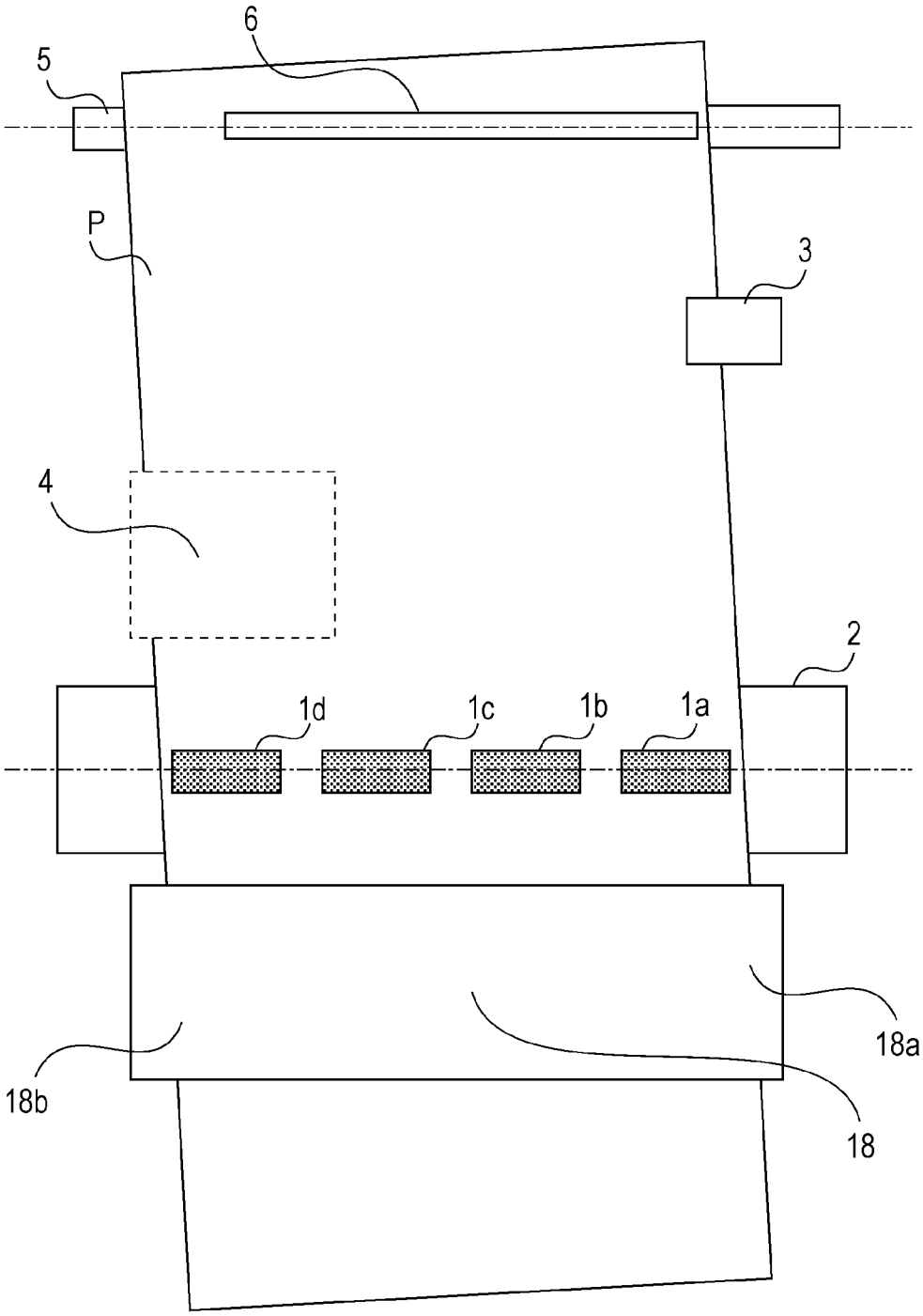
FIG. 11 is a top view of the recording apparatus according to the second embodiment.
Figure 12:
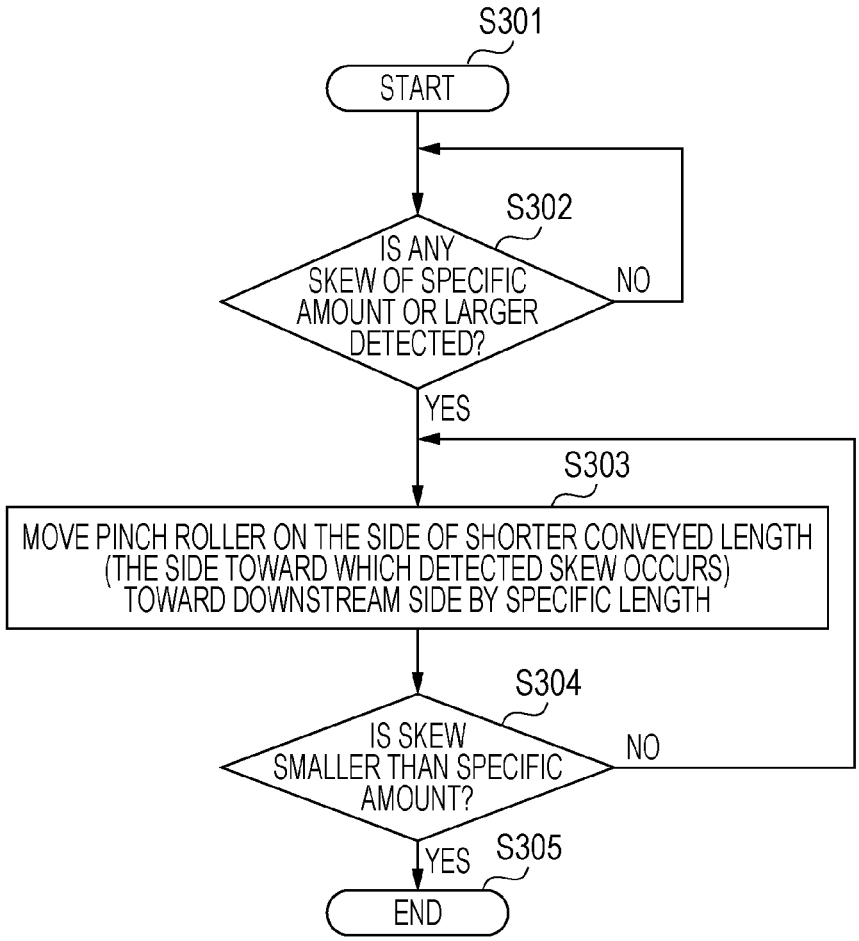
FIG. 12 is a flowchart of a skew-correcting operation according to the second embodiment.

FIGS. 10A and 10B and 11 are a cross-sectional view and top views of a recording apparatus according to a second embodiment of the present invention. FIG. 12 is a flowchart of a skew-correcting operation according to the second embodiment.

Referring to FIG. 10A, a paper-path-adjusting roller 18, functioning as a guide roller, is provided on the upstream side with respect to the LF roller 2. The paper-path-adjusting roller 18 is idle and is rotatably in contact with the front face of the recording paper P. The paper-path-adjusting roller 18 is supported at right and left ends 18*a* and 18*b* thereof by a position-changing mechanism such that the levels of the ends 18*a* and 18*b* thereof are changeable. The position-changing mechanism includes two eccentric cams 23 and two paper-path-adjusting motors 24 provided at the respective ends 18*a* and 18*b* of the paper-path-adjusting roller 18. The eccentric cams 23 change the levels of the respective ends 18*a* and 18*b* of the paper-path-adjusting roller 18. The paper-path-adjusting motors 24 rotate the respective eccentric cams 23.

The other elements are the same as those in the recording apparatus shown in FIG. 1B.

The skew-correcting operation will now be described with reference to FIG. 12.

In step S302, if any skew of a specific amount or larger is detected by the skew sensor 3 during the conveyance of the recording paper P, the operation proceeds to step S303, where skew correction is performed. In step S303, one of the ends 18*a* and 18*b* of the paper-path-adjusting roller 18 on the side toward which the recording paper P is skewed is lowered by a specific length by the position-changing mechanism. When a skew is detected, the paper-path-adjusting roller 18 is moved such that the ends 18*a* and 18*b* thereof in the paper width direction are positioned at different levels, whereby the paper path is changed in the paper width direction. Thus, as in the first embodiment, the length by which the recording paper P is in contact with the LF roller 2 is varied in the paper width direction between that on the right side and that on the left side. Thus, the skew of the recording paper P is corrected.

An exemplary case will now be considered where the recording paper P is skewed in the leftward direction as shown in FIG. 11. To correct such a skew, the left end 18*b* of the paper-path-adjusting roller 18 is lowered. The ends 18*a* and 18*b* of the paper-path-adjusting roller 18 are moved by rotating the respective eccentric cams 23 that are driven by the respective paper-path-adjusting motors 24. The recording paper P is in contact with the LF roller 2 by a lager length on the side near the end 18*b*, as shown in FIG. 10A. Therefore, a conveyance force received by the portion of the recording paper P on the side near the end 18*b* increases relative to the conveyance resistance, whereby the portion of the recording paper P on the side near the end 18*b* is conveyed by a larger length. Thus, the length of conveyance is varied between that on the right side and that on the left side of the recording paper P, whereby the skew is corrected. FIG. 10B shows a state after the skew is corrected.

The lengths by which the ends 18*a* and 18*b* of the paper-path-adjusting roller 18 are to be lowered are determined on the basis of a table, shown in FIG. 13, stored in advance in the ROM 103. FIG. 13 summarizes the lengths by which the ends 18*a* and 18*b* of the paper-path-adjusting roller 18 are lowered and the amounts of skew corresponding thereto obtained from an experiment.

If the amount of skew correction is larger or smaller than expected, the end 18*a* or 18*b* of the paper-path-adjusting roller 18 is lowered again in accordance with the difference from the expected amount of skew correction (step S304). By repeating this step, the amount of skew is adjusted to be constantly within a specific range.

Thus, unlike in the first embodiment, skew correction is performed by varying the levels of the right and left ends 18*a* and 18*b* of the paper-path-adjusting roller 18 provided on the upstream side with respect to the LF roller 2.

The recording head 13 described above is a serial head that performs printing by moving back and forth. Alternatively, the recording head 13 may be a line head including a plurality of recording heads provided side by side in the conveyance direction.

According to the second embodiment, skew correction is performed assuredly without damaging the recording medium with scratches and/or marks, regardless of the material of the conveying roller. Consequently, highly accurate conveyance of the recording medium is realized. Thus, the occurrence of deviation in image position due to a skew of the recording medium is prevented, and a high-quality printed image is output. Even in a case where the pinch roller cannot be moved because of limitations of the recording apparatus, skew correction is possible according to the second embodiment. If the configuration permits, the first and second embodiments may be applied simultaneously. In that case, it is possible to correct larger skews.

A third embodiment of the present invention will now be described.

Figure 14A:
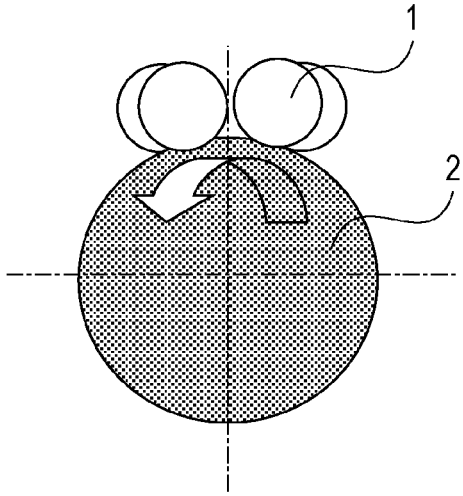
FIGS. 14A and 14B are a side view and a top view, respectively, of pinch rollers according to a third embodiment of the present invention.
Figure 14B:
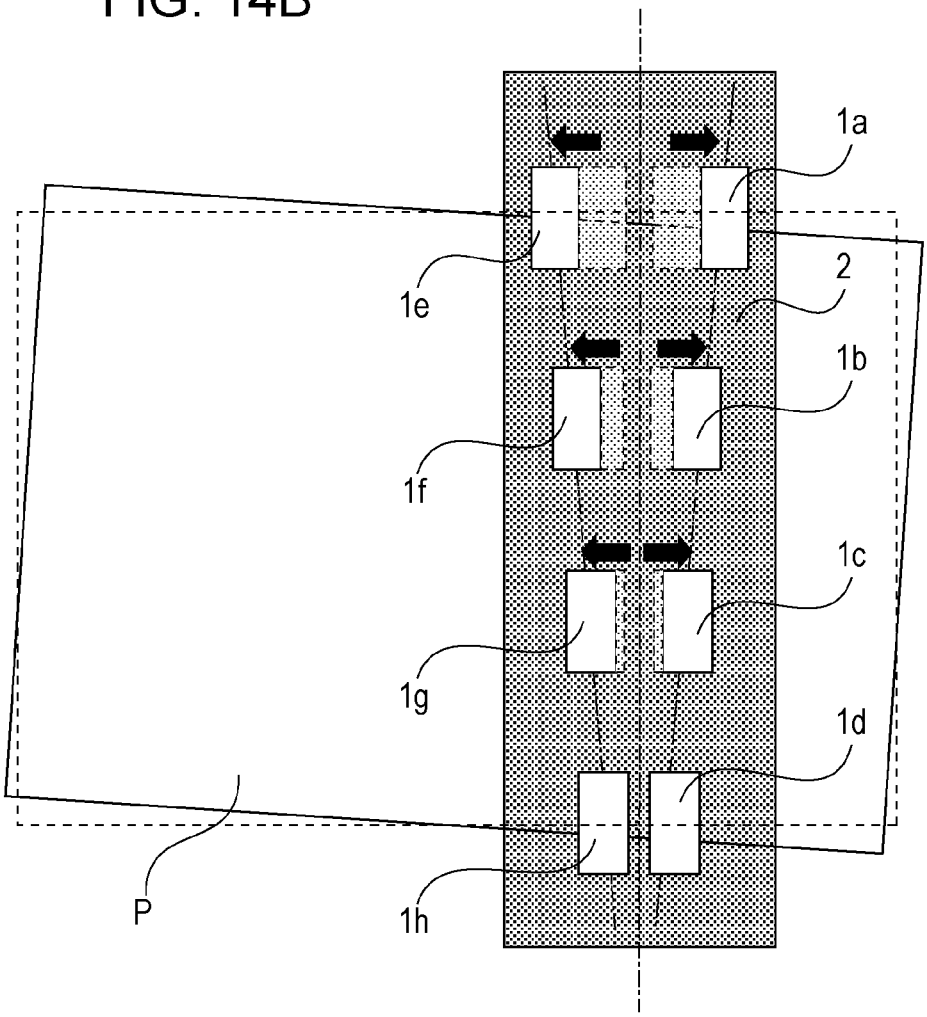
Figure 15:
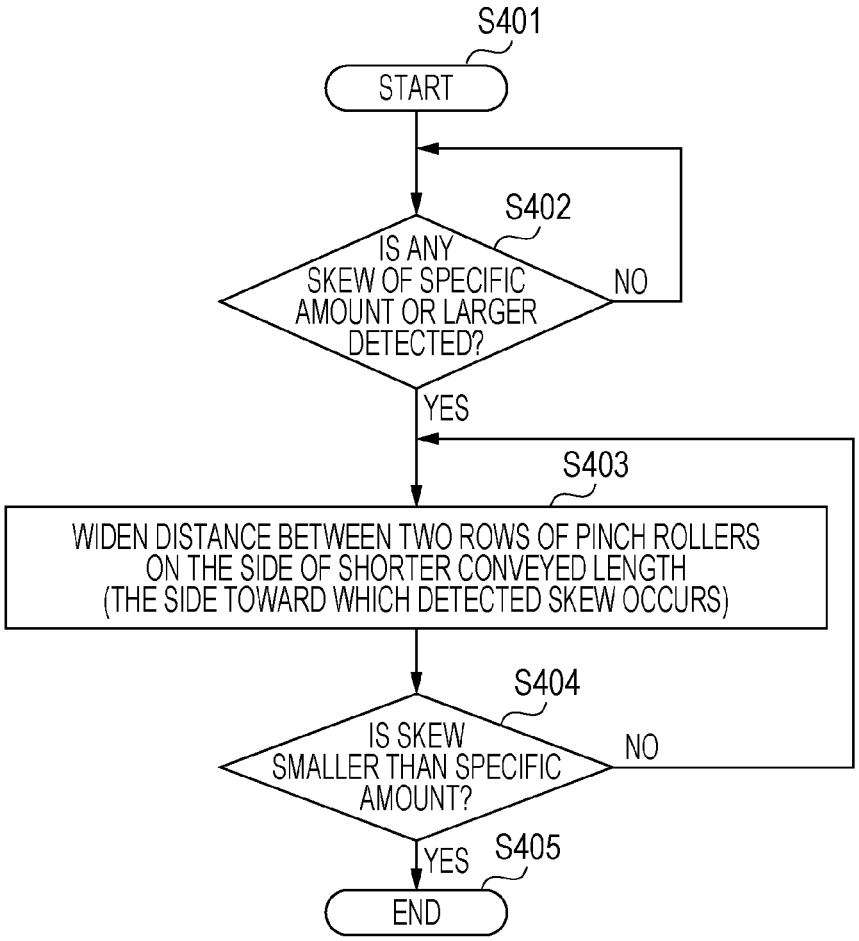
FIG. 15 is a flowchart of a skew-correcting operation according to the third embodiment.

As described in the first embodiment, in the case where rows of pinch rollers are arranged side by side in the conveyance direction, skew correction is possible by moving the pinch rollers simultaneously in a specific direction. Referring to FIGS. 14A and 14B, in a configuration in which pinch rollers 1*a* to 1*h* are arranged in two rows, skew correction is also possible by moving the pinch rollers in the row on the downstream side toward the upstream side in the conveyance direction, and the pinch rollers in the row on the upstream side toward the downstream side in the conveyance direction. FIG. 14A is a side view. FIG. 14B is a top view. FIG. 15 is a flowchart of such a skew-correcting operation.

If any skew of a specific amount or larger is detected in step S402, the pinch rollers 1*a* to 1*h* are moved in step S403. For example, FIG. 14B shows a case where the recording paper P (represented by the solid line) is skewed toward the side near the pinch roller 1*a*. To correct such a skew, the pinch rollers 1*a*, 1*b*, 1*c*, and 1*d* on the upstream side in the conveyance direction are moved from the positions represented by the broken lines toward the upstream side (to the positions represented by the solid lines) in the conveyance direction, while the pinch rollers 1*e*, 1*f*, 1*g*, and 1*h* on the downstream side in the conveyance direction are moved from the positions represented by the broken lines toward the downstream side (to the positions represented by the solid lines) in the conveyance direction. The length of movement is the largest for the pinch rollers 1*a* and 1*e*, and decreases toward the pinch rollers 1*d* and 1*h*. That is, the distance between the positions where the pinch rollers (1*a* and 1*e*) on the side toward which the recording paper P is skewed are in contact with the LF roller 2 is set so as to be larger than the distance between the positions where the pinch rollers (1*d* and 1*h*) on the opposite side are in contact with the LF roller 2. Thus, the length, in the conveyance direction, of the portion of the recording paper P that is in contact with the peripheral surface of the LF roller 2 is larger on the side near the pinch roller 1*a* than on the opposite side. Accordingly, the length of conveyance on the side near the pinch roller 1*a* is relatively larger, and the skew of the recording paper P is corrected as represented by the broken line.

Thus, skew correction is possible in the configuration in which two rows of pinch rollers are arranged side by side in the conveyance direction. By arranging pinch rollers in two rows, the recording paper P partially runs along the LF roller 2 even though skew correction is not performed. Therefore, the recording paper P has an increased strength for overcoming disturbances such as back tension, and the conveyance accuracy is expected to be further improved. Since skew correction is of course possible in such a configuration, more accurate conveyance of the recording medium is realized. Thus, the occurrence of deviation in image position due to a skew of the recording medium is prevented, and a high-quality printed image is output.

The recording head 13 described in each of the above embodiments is a serial head that performs printing by moving back and forth. Alternatively, the recording head 13 may be a line head in which a plurality of recording heads having ink ejection ports covering the entire width of the recording paper P are provided side by side in the conveyance direction.

The LF roller 2 described in each of the above embodiments may be a rigid roller made of a metal shaft coated with ceramic. By employing a rigid, high-accuracy conveying roller, errors in conveyance are reduced as much as possible, and skew correction is performed assuredly without damaging the recording medium with scratches and/or marks. Consequently, highly accurate conveyance of the recording medium is realized. Thus, a high-quality printed image is output.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-279915 filed Dec. 9, 2009, which is hereby incorporated by reference herein in its entirety.

What is claimed is:

1. A device comprising:

a conveying roller configured to convey a recording medium;

a plurality of pinch rollers configured to press the recording medium against the conveying roller;

a detector configured to detect a direction of skew of the conveyed recording medium; and a mechanism configured to move at least one of the pluralities of pinch rollers along circumference of the conveying roller in accordance with a result of a detection by the detector, such that a length of a portion of the conveying roller that is in contact with the recording medium in a conveyance direction is larger on one side toward which the recording medium deviates by the skew than on the other side.

2. The device according to claim 1, wherein the mechanism operates such that some of the pinch rollers on the side toward which the recording medium deviates by the skew are moved by larger lengths in the conveyance direction than the other pinch rollers on the opposite side are moved.

3. The device according to claim 1, wherein the mechanism operates such that some of the pinch rollers are moved toward a downstream side in the conveyance direction and the other pinch rollers are moved toward an upstream side in the conveyance direction, and such that distances in the conveyance direction between positions where the pinch rollers moved toward the downstream side are in contact with the conveying roller and positions where the pinch rollers moved toward the upstream side are in contact with the conveying roller are larger on the side toward which the recording medium deviates by the skew than on the opposite side.

4. The device according to claim 1, wherein the detector detects an amount of skew of the recording medium and moves the pinch rollers by lengths corresponding to the amount of skew.

5. The device according to claim 1, wherein the recording medium is continuous-form paper that is unwound from a roll of paper, wherein a cutter configured to cut the continuous-form paper is provided on a downstream side in the conveyance direction with respect to the conveying roller, wherein the detector detects an amount of skew of the continuous-form paper, and wherein, when the detected amount of skew is larger than or equal to a specific amount, the continuous-form paper that is being conveyed is cut with the cutter, the continuous-form paper is conveyed to a position on the upstream side with respect to the conveying roller, the mechanism moves the pinch rollers such that the length is larger on the side toward which the continuous-form paper deviates by the skew than on the opposite side, and subsequently the continuous-form paper is conveyed by the conveying roller.

6. The device according to claim 5, wherein the mechanism moves the pinch rollers by lengths corresponding to the detected amount of skew.

7. An apparatus comprising:

the device according to claim 1; and a recording unit configured to perform recording on the recording medium conveyed by the device.

8. The apparatus according to claim 7, wherein the recording unit is an inkjet recording unit.

9. The apparatus according to claim 8, wherein the recording unit includes a plurality of recording heads having ink ejection ports covering an entire width of the recording medium, the recording heads being provided side by side in the conveyance direction.

10. The apparatus according to claim 7, wherein the mechanism operates such that some of the pinch rollers on the side toward which the recording medium deviates by the skew are moved by larger lengths in the conveyance direction than the other pinch rollers on the opposite side are moved.

11. The apparatus according to claim 7, wherein the mechanism operates such that some of the pinch rollers are moved toward a downstream side in the conveyance direction and the other pinch rollers are moved toward an upstream side in the conveyance direction, and such that distances in the conveyance direction between positions where the pinch rollers moved toward the downstream side are in contact with the conveying roller and positions where the pinch rollers moved toward the upstream side are in contact with the conveying roller are larger on the side toward which the recording medium deviates by the skew than on the opposite side.

12. The apparatus according to claim 7, wherein the detector detects an amount of skew of the recording medium and moves the pinch rollers by lengths corresponding to the amount of skew.

13. The apparatus according to claim 7, wherein the recording medium is continuous-form paper that is unwound from a roll of paper, wherein a cutter configured to cut the continuous-form paper is provided on a downstream side in the conveyance direction with respect to the conveying roller, wherein the detector detects an amount of skew of the continuous-form paper, and wherein, when the detected amount of skew is larger than or equal to a specific amount, the continuous-form paper that is being conveyed is cut with the cutter, the continuous-form paper is conveyed to a position on the upstream side with respect to the conveying roller, the mechanism moves the pinch rollers such that the length is larger on the side toward which the continuous-form paper deviates by the skew than on the opposite side, and subsequently the continuous-form paper is conveyed by the conveying roller.

14. The apparatus according to claim 13, wherein the mechanism moves the pinch rollers by lengths corresponding to the detected amount of skew.

* * * * *